US006698961B2

(12) United States Patent
Pollock

(10) Patent No.: US 6,698,961 B2
(45) Date of Patent: Mar. 2, 2004

(54) GROUT SEALER APPLICATOR BRUSH

(76) Inventor: Richard Pollock, 21218 St. Andrews Blvd., Boca Raton, FL (US) 33433

( * ) Notice: Subject to any disclaimer, the term of this patent is extended or adjusted under 35 U.S.C. 154(b) by 0 days.

(21) Appl. No.: 10/395,459

(22) Filed: Mar. 24, 2003

(65) Prior Publication Data

US 2003/0180086 A1 Sep. 25, 2003

Related U.S. Application Data

(60) Provisional application No. 60/367,151, filed on Mar. 25, 2002.

(51) Int. Cl.[7] ..... A46B 11/06

(52) U.S. Cl. ..... 401/289; 401/140; 401/282; 401/183

(58) Field of Search ..... 401/288, 140, 401/138, 291, 270, 282, 183, 184, 185, 186; 222/547; 138/37, 40, 42, 43, 44, 45, 46

(56) References Cited

U.S. PATENT DOCUMENTS

| | | | | | |
|---|---|---|---|---|---|
| 409,415 | A | * | 8/1889 | Matzier et al. | 401/270 |
| 879,706 | A | * | 2/1908 | Watson | 401/270 |
| 1,476,610 | A | * | 12/1923 | Herbert et al. | 401/282 |
| 2,211,275 | A | * | 8/1940 | Lachapelle | 401/140 |
| 2,575,124 | A | * | 11/1951 | Pollitt | 222/162 |
| 2,641,011 | A | * | 6/1953 | Caronia | 401/291 |
| 3,135,990 | A | * | 6/1964 | Bergmann et al. | 401/286 |

* cited by examiner

*Primary Examiner*—David J. Walczak
(74) *Attorney, Agent, or Firm*—Kevin Redmond

(57) ABSTRACT

A grout sealer applicator brush that carries with it a reservoir of grout sealer. The brush includes a handle with a broad concave upper surface used to support and cradle the reservoir. The grout sealer within the reservoir is conducted through a tube that dispenses the fluid directly on the bristles of the brush, ready for application to the grout. The reservoir is placed in proximity to the bristle to reduce the torque of the reservoir on the operator. Holding the reservoir in place is a handle, cradling arrangement that can accommodate different sized reservoirs. To reduce manufacturing costs, the brush and the tube are all formed simultaneously, typically of plastic, in a pressure molding process.

2 Claims, 5 Drawing Sheets

GROUT SEALER APPLICATOR BRUSH

This application claims the benefit of provisional application No. 60/367,151 filed on Mar. 25, 2002.

BACKGROUND

1. Field

The present invention relates to devices and methods for sealing grout joints between tile and more specifically to brushes that carry a grout sealer which is applied to the grout by way of the brush.

2. Prior Art

The grout between ceramic tiles usually contains portland cement and as such is porous, making it subject to stain and mildew. Because of the porosity of the grout, the stain is able to penetrate into the grout, making its removal difficult. This stain is removed by a grout cleaning agent and a brush that penetrates the space between the tiles and reaches the grout. Once the grout is cleaned in this manner it is then sealed to retard further staining. The grout sealer, which is usually applied with a brush contains a coloring agent that aids in bringing the grout back to its original color.

Prior art brushes, used for the application of grout sealants, typically include, a reservoir of grout sealant which is attached to a grout sealant brush that includes a handle. The fluid within the reservoir is conducted from the reservoir to the bristles by means of a tube. The reservoir is attached to an end of the handle that is furthest from the brush bristles; however, the brush handle is gripped by an operator at the opposite end of the brush near the bristles. There is often a distance of 8 to 12 inches between the operator's hand and the reservoir. Consequently, the reservoir and the sealant apply a torque on the handle that the operator must counteract. The operator must apply a counter torque, while at the same time applying a downward and sweeping stroke force to apply the sealer to the grout. The counter torque accomplishes no work, but is tiring for the operator.

The reservoir is typically a cylindrical plastic bottle that is attached to the brush handle by means of a large clamp made of one or two metal plates which partially surround the bottle. Different size bottles cannot be accommodated because of the fixed position of the plates. The grip of the plates is somewhat loosened as the bottle is emptied, making the bottle prone to slipping out between plates as it becomes empty.

In most prior art sealer application, the brush handle, clamp, bristles and the tube that connects the reservoir to the bristles are all separate components. These separate components must all be fabricated individually and then assembled to form the complete brush. This is obviously a costly, labor intensive method of manufacturer.

The present invention, described below, provides means for overcoming all of the short comings of the prior art noted above.

SUMMARY

It is an object of the present invention to provide a one piece molded brush which includes an integral fluid tube that directly feeds grout sealer to the bristles of the brush.

It is an object of the present invention to provide a brush with a handle that includes an upper concave surface used to support and cradle a reservoir of grout sealer.

It is an object of the present invention to provide a grout sealant application brush with a reservoir having its center of gravity located close to the bristles to reduce torque on the operator.

It is an object of the present invention to provide a grout sealant application brush with a reservoir having an off set opening to aid in completely draining the reservoir.

The present invention is a grout sealer application brush that carries with it a reservoir of grout sealer. The brush includes a handle with a broad concave upper surface used to support and cradle the reservoir. Grout sealer within the reservoir is conducted through a tube that dispenses the fluid directly on the bristles of the brush, ready for application to the grout. The reservoir is placed in proximity to the bristles to reduce the torque of the reservoir on the operator. Holding the reservoir in place on the handle is a strap arrangement that can accommodate different sized reservoirs. To reduce manufacturing costs, the brush and the tube are all formed simultaneously, typically of plastic, in a pressure molding process.

The sealer from the reservoir is passed through a fluid control valve to permit adjustment of the amount of sealer reaching the bristles. This feature is useful with sealers of low viscosity but may be eliminated with high viscosity sealers. In another embodiment, a constricting device is inserted to slow the flow from the reservoir of low viscosity sealers. The fluid sealer from the reservoir is located generally over the hand of the operator to shorten the distance from the center of gravity of the reservoir to the center of support by the hand. This reduces the torque that must be countered by the hand of the operator. This feature reduces fatigue, permitting the operator to carry out the cleaning operation over longer periods of time than would be possible with prior art brush designs that produce high torque which must be counteracted by the operator.

DETAILED DESCRIPTION OF THE INVENTION

Figure 1:
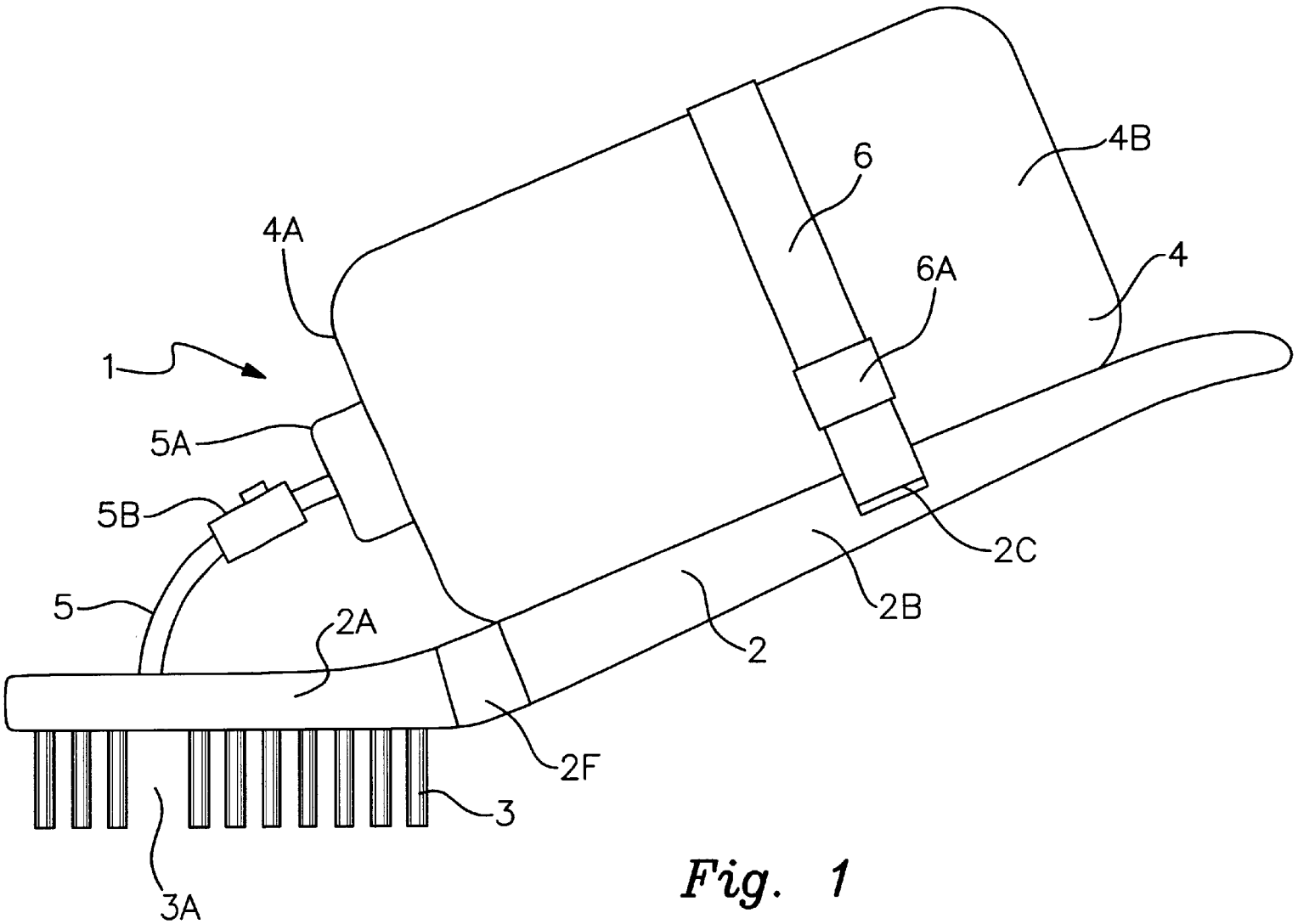
FIG. 1 is a side elevation view of a brush assembly, illustrating the relative positions of the reservoir, the reservoir strap, the brush handle, the brush bristles, the fluid tube and a sealer shut off valve.

FIG. 1 is a side elevation view of a brush assembly 1, illustrating the relative position of the reservoir 4, the reservoir strap 6, the brush handle 2, the brush bristles 3, the fluid tube 5 and a sealer shut off valve SB. The handle is considered as having a central longitudinal axis which is held generally in the horizontal plane in this Figure for illustrative purposes. The handle has a first or front end shown to the left in FIG. 1 and a second or rear end shown to the right in this Figure. The rear portion of the brush handle 2B is wider than the front end. FIG. 1 also shows the invention to include a hole 2C in the rear or second portion of the handle for the strap, a first surface or front of the reservoir 4A, a rear surface of the reservoir 4B and an adapter 5A on the first surface of the reservoir connecting the fluid tube to the reservoir. As can be seen in this Figure, the reservoir is typically cylindrical in shape and is strapped to the wide or rear portion of the handle by strap 6. The front end of the reservoir is connected to the front end of the brush where the bristles are located by way of fluid tube and this tube delivers sealer from the reservoir to the brush at a point 3A where the bristles are shown to be parted. The bottom side of the reservoir lies on the top of the handle. The bristles 3 are located under the brush handle at the front, narrow end of the brush and cover less than 50% of the bottom of the brush handle. The front of the reservoir is located no more than 3 inches from where the bristles terminate on the handle to reduce the torque on the operator's hand produced by the weight of the sealer in the reservoir. The fluid tube is connected to the upper side of the handle and penetrates through the handle to the bristles to conduct the sealer to the bristles. Located on the fluid tube is a fluid shut off valve 5B which is used to adjust the amount of fluid flowing from the reservoir to the bristles.

Figure 6:
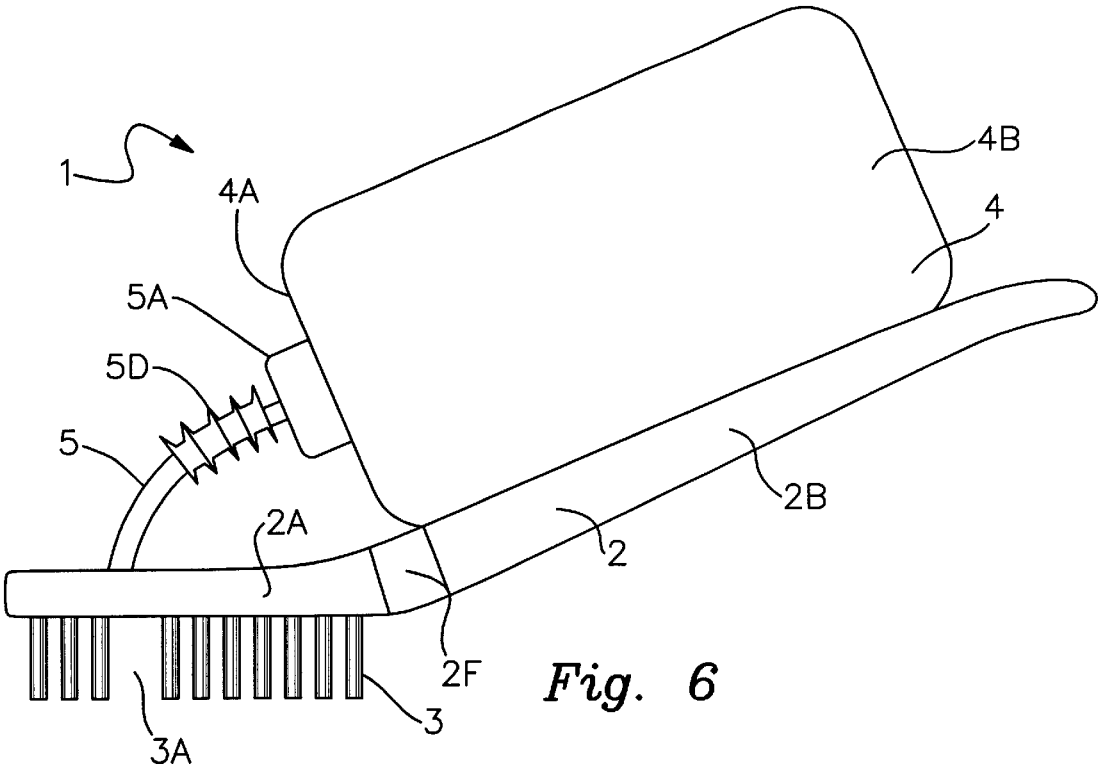
FIG. 6 is a second embodiment of the present invention which eliminates the need for the strap and the shut off valve shown in the embodiment of FIG. 1.

As noted earlier, where low viscosity sealers are used, this valve is used to slow the flow. Where high viscosity sealers are used, this valve is unnecessary. A system which does not use a shut off valve is shown in FIG. 6. This system, which is described below, uses direct pressure on the reservoir to compensate for the slow flow of high viscosity sealers.

Figure 2:
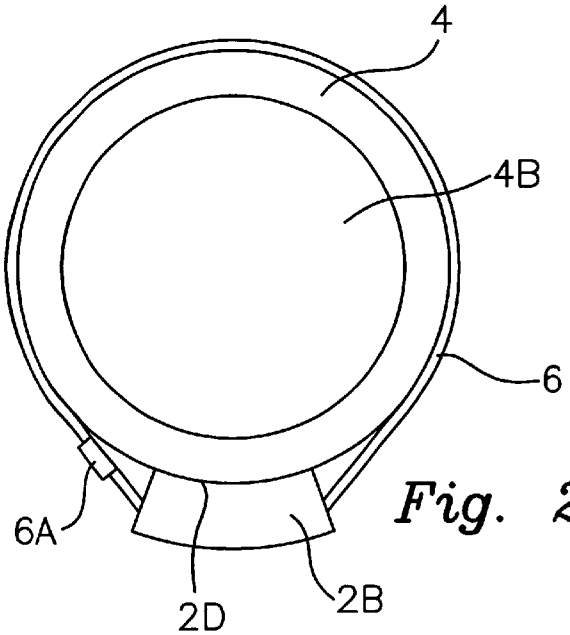
FIG. 2 is a rear view of the brush assembly of FIG. 1 with the reservoir held in a concave depression located on the upper portion of the brush handle.

As can be seen in FIG. 1, the strap 6 passes through a slot 2C in the wide portion of the handle 2B and continues about the reservoir to hold it in position on the brush. FIG. 2 shows a rear view brush assembly of FIG. 1 illustrating the reservoir 6 which is held in a concave depression 2D located on the upper portion of the brush handle 2B. In FIG. 2 the rear surface of the reservoir 4B and the location where the strap enters and leaves the handle 2B are clearly evident.

Figure 3:
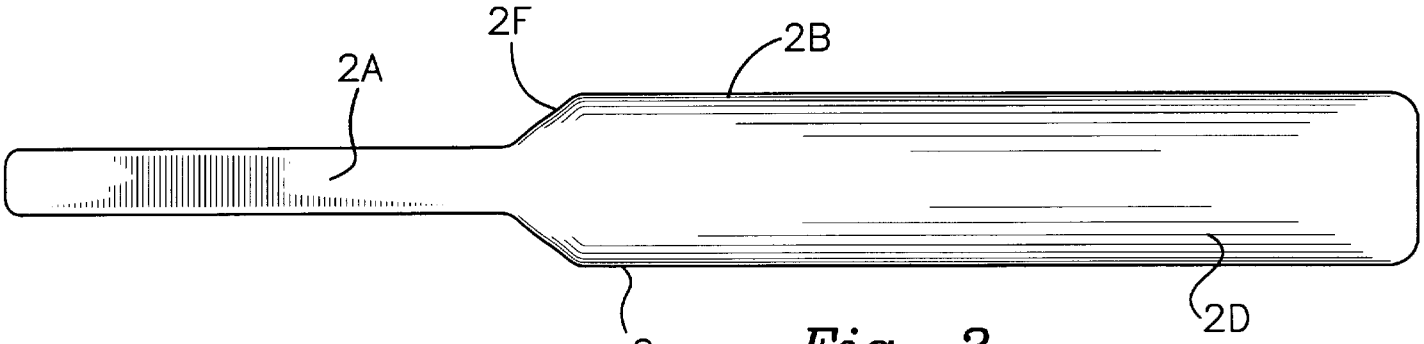
FIG. 3 is a top view of the brush handle showing the relative location of the concave portion of the brush handle.

FIG. 3 is a top view of the brush handle showing that the concave portion 2D, which is used to cradle the reservoir 4, is located on the upper surface of the rear portion 2B of the handle. The narrow width of the handle at its front end 2A is also clearly evident, especially when it is contrasted with the wider portion 2B which is shown to the right in this Figure. The transition point 2F between the wide and narrow portion is located about one third the length of the handle from its front end.

Figure 4:
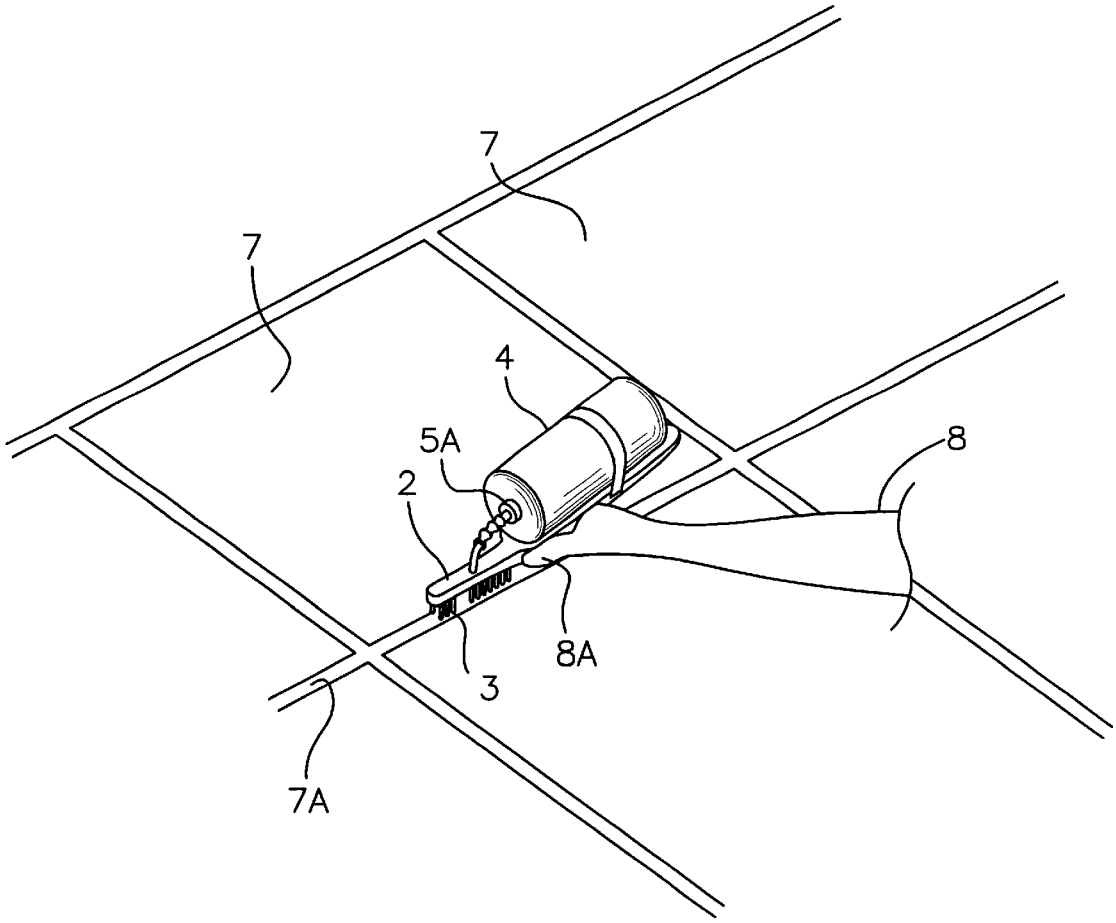
FIG. 4 is a perspective view of a tiled floor showing the method of using the brush assembly to apply the sealant to the grout lines between the tiles.

FIG. 4 is a perspective view of tile floor showing the brush 2 with the reservoir 4 attached being used to apply sealer to a grout strip 7A between the tile 7. An operator's hand 8A grips the brush 2 behind the bristles 3 and directly below the adapter 5A. This places a large portion of the weight due to the reservoir above the hand and as the reservoir drains, more of the weight of the fluid becomes positioned directly over the operator's hand, reducing the torque produced by the fluid in the reservoir. In some prior art systems, the reservoir was located 8 to 10 inches behind the hand, creating a much larger torque which had to be counteracted by the operator. This is limited in the present invention by placing the reservoir no more than 3 inches away from the right end of the bristles as shown in FIG. 1.

Figure 5:
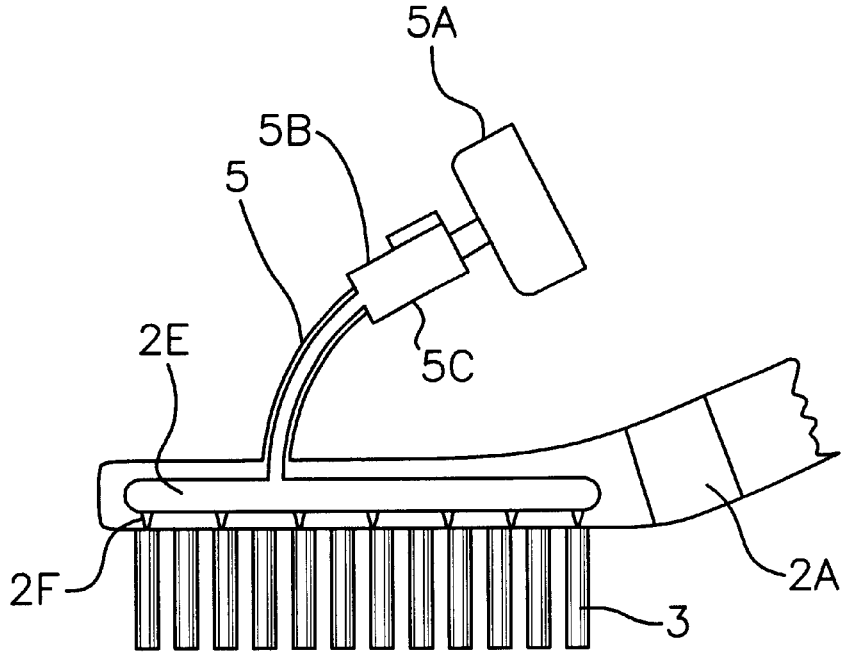
FIG. 5 is a side cross sectional view of the forward portion of the brush showing an embodiment which includes an internal chamber to distribute cleaning fluid over all the bristles.

FIG. 5 is a side cross sectional view of the forward portion of the brush 2A showing an embodiment of the brush which includes an internal chamber 2E within the brush handle over the bristles that distributed sealer uniformly to the bristles through ports, such as port 2F, which are located along the bottom of chamber 2E over the bristles. Chamber 2E is connected at its top to tube 5 to accept fluid from the reservoir and feeds the sealer through the ports on its bottom to all the bristles, rather than at a single point, such as point 3A shown in FIG. 1.

In the operation of this invention, the fluid adjustment valve 5B is adjusted to produce a slow flow of sealer from the reservoir 4 into the bristles at point 3A. The fluid flows into the bristles and is applied in a smooth flowing action over the grout. The operator never has to stop the application to apply fluid to the grout, as it is automatically fed to the bristles by gravity from the reservoir. The concave portion on the wider rear portion of the brush 2B serves to support and cradle the reservoir. The strap 6 easily can be adjusted to accommodate different size reservoirs using the adjustment clip 6A on the strap. All that is necessary is to adjust the tightness of the strap using the clip 6A. The adjustability of the strap also permits adjustment for reservoirs that are partially empty and might slip out of the fixed grip of prior art devices.

In the prior art, the fluid tube 5 was typically separately fabricated from copper tubing. The brush handle, the adapter and the adjustment valve were also separately fabricated and then assembled. This method of manufacture is still possible with the present invention, however, to reduce manufacturing cost, all of these components are formed in a pressure molding process, where one or at most two pieces are produced and then joined together to form a single component. This approach greatly reduces the manufacturing cost for this brush assembly.

FIG. 6 shows a side view of a second embodiment of the present invention. In this embodiment the reservoir 4 rests in the concave portion 2D of the handle 2 and is also supported by its connection to the fluid tube 5, which is typically made of ridged plastic to aid in holding the reservoir in place.

To accommodate different reservoir sizes, a third embodiment of the invention includes a semi-flexible accordian-like section 5D in the fluid tube 5 to permit some adjustment in the height of the connection 5A to the reservoir. In an alternative embodiment no flexible section is used. A fixed fluid tube 5 is installed for a particular reservoir size. Each brush is designed for a particular reservoir size.

Figure 7:
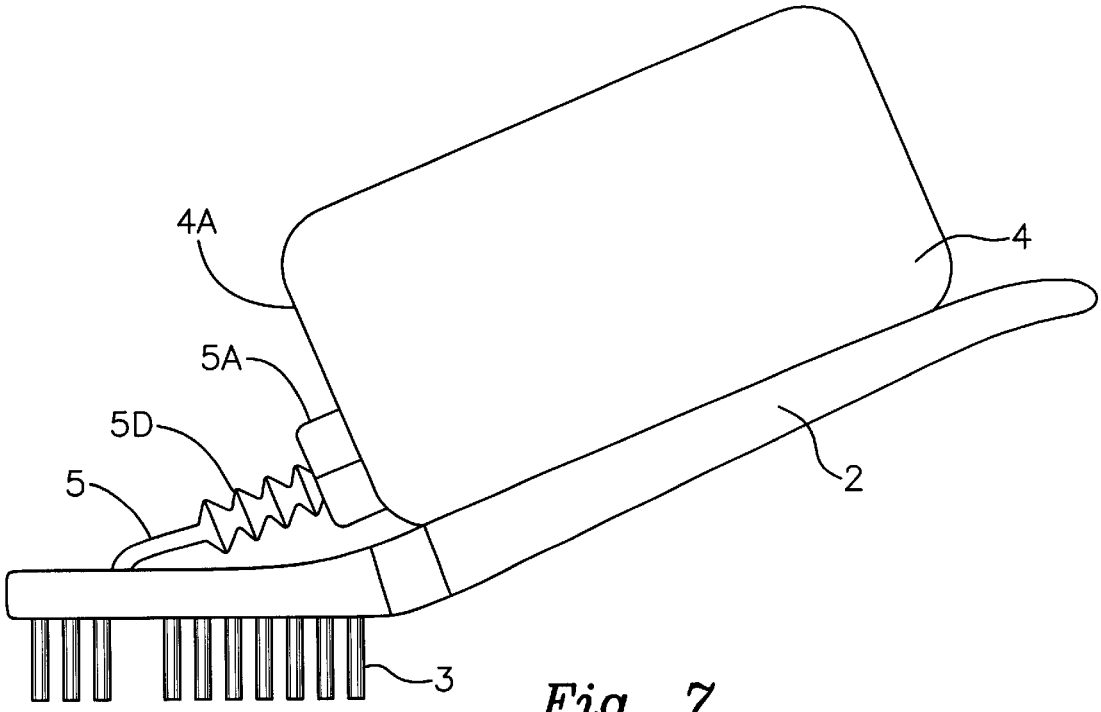
FIG. 7 is a third embodiment of the present invention showing the reservoir to have its connection to the fluid tube positioned low and close to the handle to aid in totally emptying the bottle.

FIG. 7 is an embodiment which places the adapter 5A in an off set position where the adapter is positioned low with respect to the central axis of the reservoir to allow virtually complete emptying of the reservoir without removing the brush from the grout to tip the reservoir upwards as was required with prior art devices. The operation can continue longer with applying the sealer without interruption.

The fluid shut off valve 5A is not used in the embodiment shown in FIG. 6 because this embodiment is intended for use with high viscosity sealers. The reservoir must be gripped by hand and then squeezed to force the sealer out of the bottle and into the fluid tube 5. The sealer then flows on the bristles 3A where it is applies to the grout in a smooth continuous unidirection motion along the grout lines. Once hand pressure is released from the reservoir, the high viscosity sealer stops flowing, eliminating the need for a shut off valve.

Figure 8:
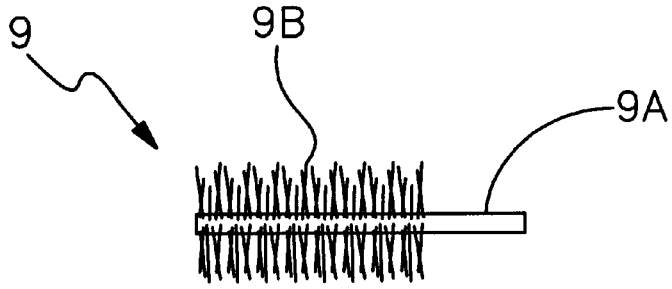
FIG. 8 is a side view of a constrictive device for insertion into the fluid tube to slow the flow of low viscosity sealers.

FIG. 8 shows a side view of a constrictive device 9 for insertion in the fluid tube to slow the flow of low viscosity sealers. This device includes a central shaft 9A with a series of projections 9B extending out from the shaft. One end of the shaft has no projections to facilitate gripping the device. The projections may be made of many materials such as soft bristles or soft metal needles with blunt ends to protect the fluid tube. The degree of constriction is varied by varying the density of the bristles. Significantly different viscosities may be accommodated by installing different constrictive devices to function with the specific viscosity of the sealer. It is clear that any form of constriction may be used to slow the flow. For example, a simple rod which reduces the effective cross section of the fluid tube may be used. However, testing has shown that constriction devices which include bristles provide very satisfactory results when used to control low viscosity sealers.

There are a number of possible alternates that would be evident to those skilled in the art after reviewing the above disclosure. Among these are the removal of the bristle parting 3A, and an external tube distribution line outside the handle with multiple ports through the handle to deliver fluid to multiple locations along the bristles rather than at one point in the bristles.

Having described my invention, I claim:

1. A grout sealer applicator brush comprising:

(a) a handle having a longitudinal axis, a first end, a second end, a top side and a bottom side, said axis being positioned in the horizontal plane for descriptive purposes, (b) a plurality of bristles attached to the bottom side of said handle adjacent the first end of said handle and extending downwardly from said handle, (c) a reservoir to carry sealer positioned above the top of said handle adjacent said second end of said handle, said reservoir having a plurality of sides, (d) a fluid tube having a first and a second end, said first end being connected to a first side of said reservoir and said second end to the bottom of said handle in the areas containing said bristles to deliver sealer from said reservoir to said bristles, and (e) a constriction device, said device being inserted in said fluid tube to adjust the flow by constricting the tube and impeding the flow of sealer from said reservoir to said bristles, and wherein said constriction device includes a central shaft, and bristles connected to and extending generally radially outward from said shaft.

2. An applicator brush as claimed in claim 1 wherein said reservoir is cylindrical and the top side of said handle is concave to provide a surface that generally fits the round cylindrical contours of said reservoir and thereby supports said reservoir on said handle.

* * * * *